US007411346B2

(12) United States Patent
Kim et al.

(10) Patent No.: US 7,411,346 B2
(45) Date of Patent: Aug. 12, 2008

(54) PLASMA DISPLAY PANEL HAVING MULTIPLE SUBSTRATE PARTS

(75) Inventors: Young-mo Kim, Suwon-si (KR); Hidekazu Hatanaka, Seongnam-si (KR); Ho-nyeon Lee, Seongnam-si (KR); Seung-hyun Son, Hwaseong-si (KR); Sang-hun Jang, Yongin-si (KR); Seong-eui Lee, Seongnam-si (KR); Gi-young Kim, Yongin-si (KR); Hyoung-bin Park, Seongnam-si (KR)

(73) Assignee: Samsung SDI Co., Ltd., Suwon (KR)

( * ) Notice: Subject to any disclaimer, the term of this patent is extended or adjusted under 35 U.S.C. 154(b) by 68 days.

(21) Appl. No.: 11/133,179

(22) Filed: May 20, 2005

(65) Prior Publication Data

US 2006/0028140 A1 Feb. 9, 2006

(30) Foreign Application Priority Data

Aug. 3, 2004 (KR) ..... 10-2004-0061091

(51) Int. Cl.
*H01J 17/49* (2006.01)
*H01K 1/58* (2006.01)

(52) U.S. Cl. ..... 313/582; 313/11; 313/44

(58) Field of Classification Search ..... 313/11, 313/39, 40, 44, 45, 582–587
See application file for complete search history.

(56) References Cited

U.S. PATENT DOCUMENTS 5,831,374 A * 11/1998 Morita et al. ..... 313/46
5,971,566 A * 10/1999 Tani et al. ..... 362/294
6,181,405 B1 * 1/2001 Izumi ..... 349/153
6,329,751 B2 * 12/2001 Yoo ..... 313/582
6,346,334 B1 * 2/2002 Kamitani ..... 428/521
6,551,720 B2 * 4/2003 Sreeram et al. ..... 428/469
6,617,767 B2 * 9/2003 Juen ..... 313/44
6,774,543 B2 * 8/2004 Kim et al. ..... 313/46
6,849,992 B2 * 2/2005 Kim et al. ..... 313/46
6,897,602 B2 * 5/2005 Son ..... 313/45
7,084,568 B2 * 8/2006 Kim ..... 313/582
7,102,285 B2 * 9/2006 Chen ..... 313/582
2002/0070665 A1 * 6/2002 Nishiki et al. ..... 313/582
2002/0079795 A1 * 6/2002 Son ..... 313/45
2003/0102789 A1 * 6/2003 Kim et al. ..... 313/44

FOREIGN PATENT DOCUMENTS

JP 2005061747 A * 3/2005

OTHER PUBLICATIONS

Computer translation of Kishimoto.*

* cited by examiner

*Primary Examiner*—Peter Macchiarolo
(74) *Attorney, Agent, or Firm*—H.C. Park & Associates, PLC

(57) ABSTRACT

A plasma display panel including a front substrate and a rear substrate facing each other, a plurality of barrier ribs formed between the front substrate and the rear substrate, a discharge generation unit that causes a plasma discharge in a discharge space, and a fluorescent layer that generates visible light due to the discharge. The rear substrate includes at least two rear substrate parts connected to each other.

22 Claims, 9 Drawing Sheets

PLASMA DISPLAY PANEL HAVING MULTIPLE SUBSTRATE PARTS

CROSS REFERENCE TO RELATED APPLICATION

This application claims priority to and the benefit of Korean Patent Application No. 10-2004-0061091, filed on Aug. 3, 2004, which is hereby incorporated by reference for all purposes as if fully set forth herein.

BACKGROUND OF THE INVENTION

1. Field of the Invention

The present invention relates to a plasma display panel, and more particularly, to a plasma display panel that may be manufactured easier and cheaper.

2. Discussion of the Background

Generally, a plasma display panel (PDP), which displays images using electrical gas discharge, has superior display performance such as high brightness and a wide viewing angle. The PDP generates visible light by a gas discharge that occurs in discharge cells when applying direct or alternating current to electrodes in the discharge cells. The gas discharge generates ultraviolet rays that excite fluorescent materials disposed in the discharge cells, thereby causing the fluorescent materials to emit visible light.

FIG. 1 is a partial perspective view showing a conventional reflective PDP, and FIG. 2 is a cross-sectional view showing an internal structure of the reflective PDP of FIG. 1. In FIG. 2, a rear substrate is shown rotated by 90° to clearly show the PDP's internal structure.

Referring to FIG. 1 and FIG. 2, a front substrate 10 and a rear substrate 20 are disposed facing each other, and a plurality of barrier ribs 24 may be formed on the rear substrate 20 to maintain a predetermined distance between the substrates. Accordingly, discharge spaces 28 surrounded by the front substrate 10, the rear substrate 20, and the barrier ribs 24 are formed.

A plurality of sustaining electrode pairs 11*a* and 11*b*, which cause surface discharges, may be formed on an inner surface of the front substrate 10. The sustaining electrode pairs 11*a* and 11*b* may be formed of a transparent conductive material, such as indium tin oxide (ITO), so that visible light may transmit through the front substrate 10. Also, narrow bus electrode pairs 12*a* and 12*b* may be formed on the sustaining electrode pairs 11*a* and 11*b*, respectively, to enhance the conductivity of the sustaining electrode pairs 11*a* and 11*b*. The bus electrode pairs 12*a* and 12*b* may be formed of a metal such as Ag, Al, or Cu. A first dielectric layer 13 may cover the sustaining electrode pairs 11*a* and 11*b* and the bus electrode pairs 12*a* and 12*b*, and a protection layer 14 may cover the first dielectric layer 13.

A plurality of address electrodes 21 may be formed on an inner surface of the rear substrate 20 in a direction substantially perpendicular to the sustaining electrode pairs 11*a* and 11*b*, and a second dielectric layer 23 may cover the address electrodes 21. The barrier ribs 24 have a predetermined height, and they are formed in parallel to each other and are separated by a predetermined distance from each other. Fluorescent layers 25 may be formed on side surfaces of the barrier ribs 24 and on the second dielectric layer 23 in each discharge cell.

However, the conventional PDP having the above structure may have the following problems.

First, a larger substrate should be manufactured to increase the PDP's size. However, a large scale production facility may be needed to manufacture a large rear substrate, thereby increasing manufacturing costs. Also, a high defect rate may cause a low yield.

Second, heat generated during plasma discharge may deteriorate the PDP's operating characteristics and life span. Therefore, it is desirable that a PDP efficiently dissipates heat generated during plasma discharge.

SUMMARY OF THE INVENTION

The present invention provides a PDP that can be manufactured in a simple process at reduced cost and can dissipate generated heat to the outside.

Additional features of the invention will be set forth in the description which follows, and in part will be apparent from the description, or may be learned by practice of the invention.

The present invention discloses a PDP comprising a front substrate and a rear substrate facing each other, a plurality of barrier ribs between the front substrate and the rear substrate, a discharge generation unit that causes a plasma discharge in a discharge space, and a fluorescent layer that generates visible light due to the discharge. The rear substrate includes at least two rear substrate parts connected to each other.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE ILLUSTRATED EMBODIMENTS

The present invention will now be described more fully with reference to the accompanying drawings showing exemplary embodiments of the invention.

Figure 1:
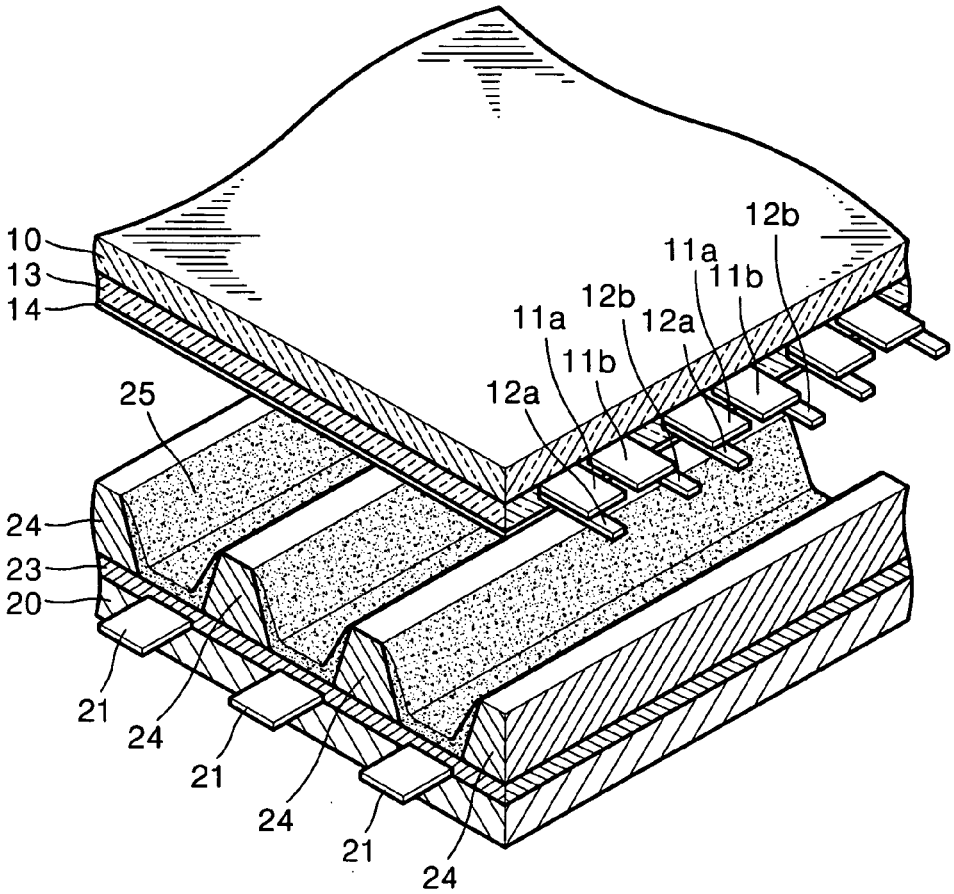
FIG. 1 (PRIOR ART)
FIG. 1 is a partial perspective view showing a conventional reflective PDP.
Figure 2:
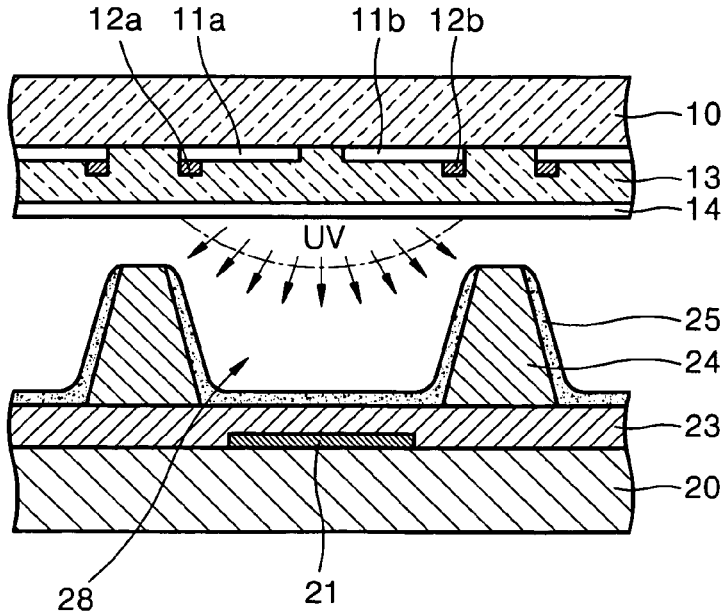
FIG. 2 (PRIOR ART)
FIG. 2 is a cross-sectional view showing an internal structure of the reflective PDP of FIG. 1.
Figure 3:
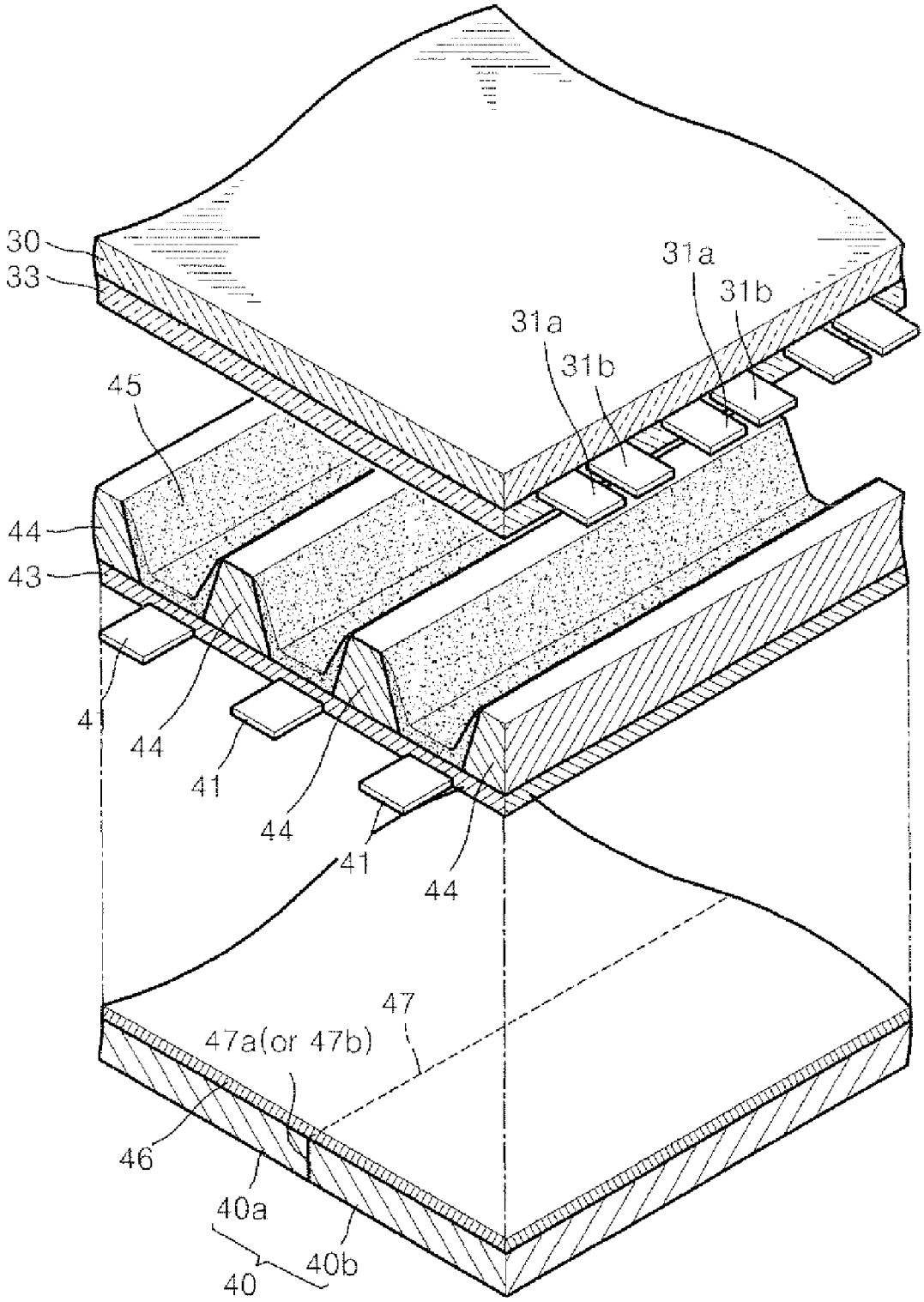
FIG. 3 is an exploded perspective view showing a reflective PDP according to a first exemplary embodiment of the present invention.
Figure 4:
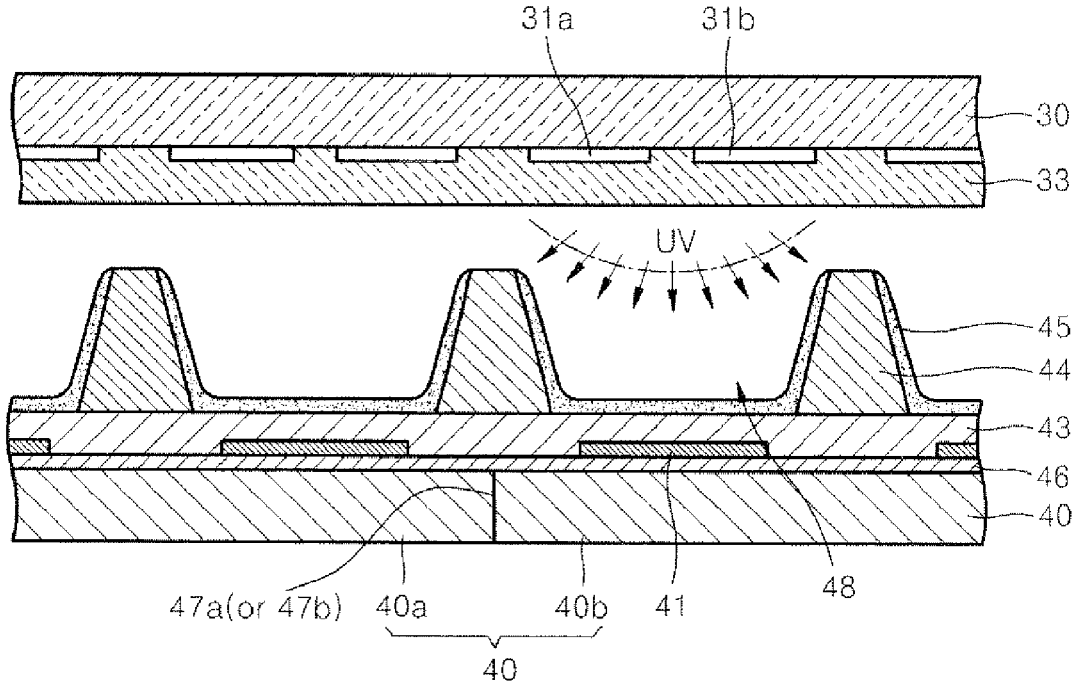
FIG. 4 is a cross-sectional view of the reflective PDP of FIG. 3.

FIG. 3 is an exploded perspective view showing a reflective PDP according to a first exemplary embodiment of the present invention, and FIG. 4 is a cross-sectional view of the reflective PDP of FIG. 3. In FIG. 4, a rear substrate is rotated by 90° in order to more clearly show the PDP's internal structure.

Referring to FIG. 3 and FIG. 4, a front substrate 30 and a rear substrate 40 may be disposed facing each other, and a plurality of barrier ribs 44 may be formed on the rear substrate 40 to maintain a predetermined gap between the substrates. Accordingly, the front substrate 30, the rear substrate 40, and the barrier ribs 44 form discharge spaces 48, and a discharge generation unit that causes a plasma discharge is formed in each of the discharge spaces 48. The discharge generation unit may include a discharge electrode, which can include at least one sustaining electrode and an address electrode.

A plurality of first and second sustaining electrode pairs 31*a* and 31*b* may be formed parallel to each other on an inner surface of the front substrate 30. The first and second sustaining electrode pairs 31*a* and 31*b* may be formed of a transparent material, such as, for example, ITO, so that visible light may transmit through the front substrate 30. A first dielectric layer 33 may cover the first and second sustaining electrode pairs 31*a* and 31*b*.

A plurality of address electrodes 41 may be formed on an inner surface of the rear substrate 40 in a direction substantially perpendicular to the first and second sustaining electrode pairs 31*a* and 31*b*, and a second dielectric layer 43 may cover the address electrodes 41. Also, the barrier ribs 44, having a predetermined height, may be formed parallel to each other, separated by a predetermined distance on the second dielectric layer 43. Fluorescent layers 45 may be formed on side surfaces of the barrier ribs 44 and on the second dielectric layer 43 in each discharge cell.

According to an exemplary embodiment of the present invention, the rear substrate 40 may include at least two rear substrate parts 40a and 40b connected to each other. A connection line 47 formed by the rear substrate parts 40*a* and 40*b* may be parallel to the address electrodes 41. A barrier rib 44 may be formed on the connection line 47.

Hence, a large scale production facility for producing a large rear substrate may be unnecessary since the rear substrate 40 may include at least two rear substrate parts 40*a* and 40*b* that are coupled together. Thus, the rear substrate may be produced in a conventional manufacturing facility. Also, the high manufacturing cost and low productivity associated with manufacturing a large scale substrate can be improved.

The rear substrate part 40*a* and the rear substrate part 40*b* may be coupled together by, for example, welding 47*a* or a coupling member that is fastened on the rear substrate parts 40*a* and 40*b* by a fastener such as, for example, tape 47*b* or a bolt.

The rear substrate parts 40*a* and 40*b* can be formed of metal, which may be cheaper and easier to process.

According to another embodiment of the present invention, a planarizing layer 46 may be formed between the rear substrate 40 and the address electrodes 41/second dielectric layer 43. The planarizing layer 46 planarizes an inner surface of the rear substrate 40 since the inner surface may not be uniform due to the connection line 47 formed by the rear substrate parts 40*a* and 40*b*. The address electrodes 41 and the second dielectric layer 43 may be formed on the planarizing layer 46. The planarizing layer 46 may insulate the address electrodes 41 and the rear substrate parts 40*a* and 40*b* from each other when the rear substrate parts 40*a* and 40*b* are formed of a conductive material, such as a metallic material.

The planarizing layer 46 may be formed of a dielectric material, such as, for example, PbO, $SiO_2$, or $Si_3N_4$, and it may be about 1-200 μm thick.

Figure 5:
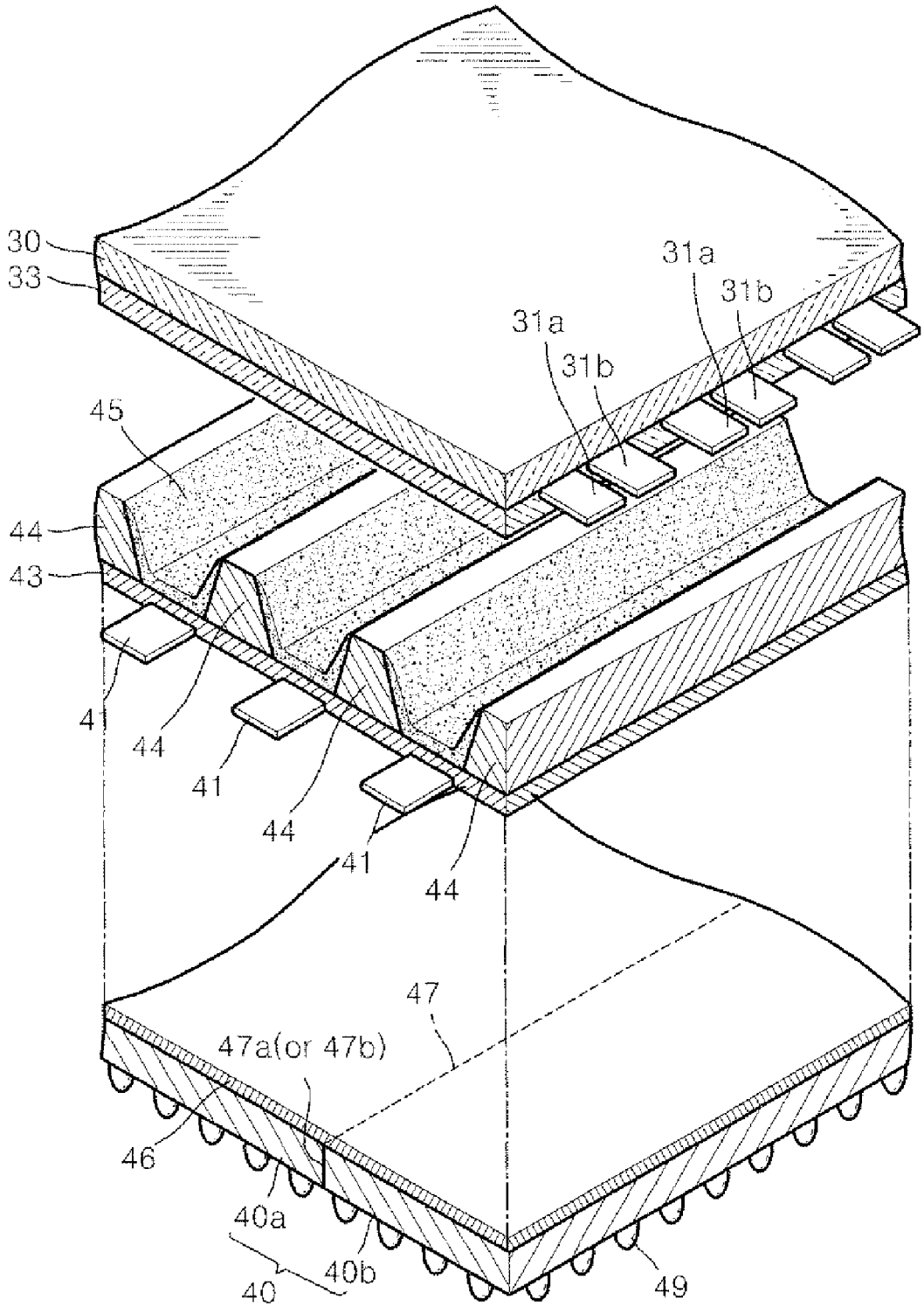
FIG. 5 is an exploded perspective view showing a reflective PDP according to a second exemplary embodiment of the present invention.
Figure 6:
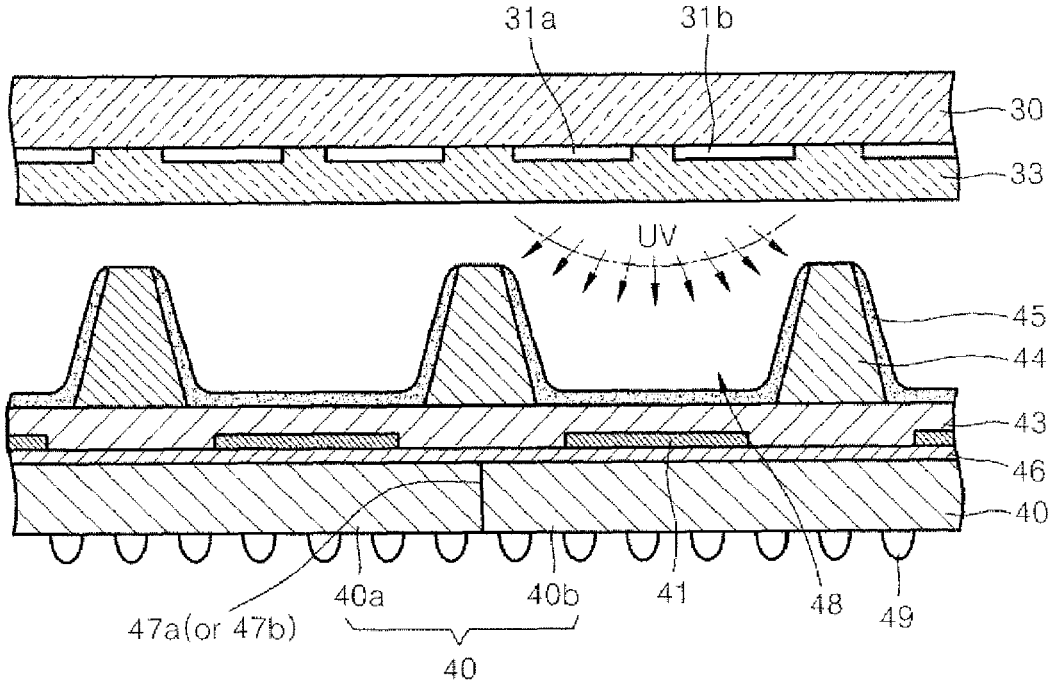
FIG. 6 is a cross-sectional view of the reflective PDP of FIG. 5.

FIG. 5 is an exploded perspective view showing a reflective PDP according to a second exemplary embodiment of the present invention, and FIG. 6 is a cross-sectional view of the reflective PDP of FIG. 5. In FIG. 6, the rear substrate is rotated by 90° to more clearly show the PDP's internal structure.

The second embodiment of the present invention will now be described. In the description of the second embodiment, new elements will be described and elements that are the same as in the first embodiment will be denoted by the same reference numerals as their counterparts in FIG. 3 and FIG. 4.

Referring to FIG. 5 and FIG. 6, a plurality of cooling pins 49, which radiate heat, may be included on an external surface of the rear substrate parts 40*a* and 40*b*. The cooling pins 49 increase the external surface's contact area with air, thereby helping to efficiently dissipate heat generated during plasma discharge to the outside. Accordingly, the cooling pins 49 may slow or prevent deterioration of the PDP's operational characteristics and life span due to heat generated during plasma discharges.

The cooling pins 49 can be formed of a material that dissipates heat, such as, for example, a metallic material, and they may be coupled with the rear substrate parts 40*a* and 40*b* or they may be manufactured with the substrate parts as one integrated body. Further, the cooling pins 49 are not limited to the configuration shown in FIG. 5 and FIG. 6. Rather, they may have various configurations provided they dissipate heat from the PDP.

Figure 7:
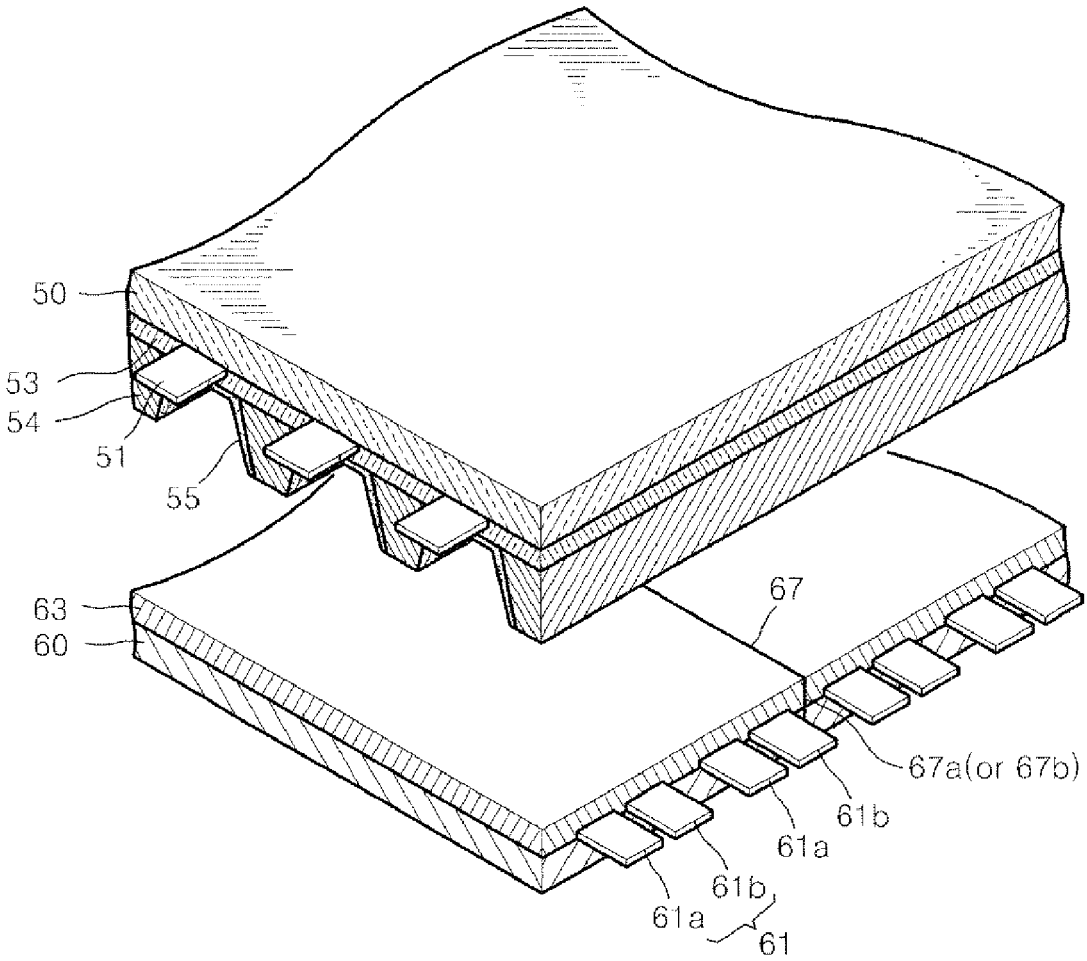
FIG. 7 is an exploded perspective view showing a transmissive PDP according to a third exemplary embodiment of the present invention.
Figure 8:
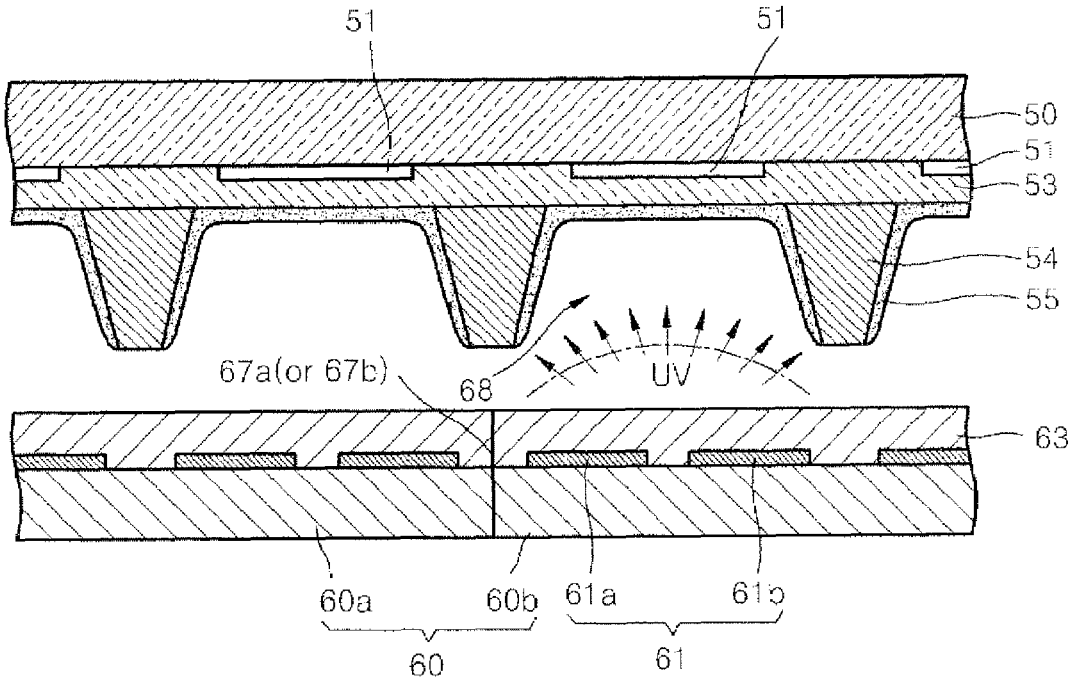
FIG. 8 is a cross-sectional view of the transmissive PDP of FIG. 7.

FIG. 7 is an exploded perspective view showing a transmissive PDP according to a third exemplary embodiment of the present invention, and FIG. 8 is a cross-sectional view of the transmissive PDP of FIG. 7. In FIG. 8, the rear substrate is rotated by 90° to more clearly show the PDP's internal structure.

Referring to FIG. 7 and FIG. 8, a front substrate 50 and a rear substrate 60 are arranged facing each other, and the rear substrate 60 may include at least two rear substrate parts 60*a* and 60*b*. A plurality of barrier ribs 54 may be formed on the front substrate 50 to maintain a predetermined gap between the front and rear substrates 50 and 60. Accordingly, the front substrate 50, the rear substrate 60, and the barrier ribs 54 surround discharge spaces 68, and a discharge generation unit that causes a plasma discharge in the discharge spaces 68 is formed. The discharge generation unit may include a discharge electrode, which can include at least one electrode of a sustaining electrode pair 61, and an address electrode 51.

A plurality of address electrodes 51, which are spaced apart a predetermined distance from, and parallel to, each other, may be formed on an inner surface of the front substrate 50. The address electrodes 51 may be formed of a transparent material, such as, for example, ITO, in order to transmit visible light through the front substrate 50. The address electrodes 51 may be buried by a first dielectric layer 53. A plurality of barrier ribs 54 having a predetermined height may be formed separated by a predetermined distance from, and parallel to, each other on the first dielectric layer 53. Fluorescent layers 55, which generate visible light in response to a plasma discharge, may be formed on side surfaces of the barrier ribs 54 and on the first dielectric layer 53 in each discharge cell.

A plurality of first and second sustaining electrode pairs 61*a* and 61*b* may be formed on an inner surface of the rear substrate parts 60*a* and 60*b* in parallel to each other and in a direction substantially perpendicular to the address electrodes 51. A second dielectric layer 63 may cover the first and second sustaining electrode pairs 61*a* and 61*b*.

At least two rear substrate parts 60*a* and 60*b* may be connected to each other, and a connection line 67 formed by the connection of the rear substrate parts 60*a* and 60*b* may be parallel to the first and second sustaining electrode pairs 61*a* and 61*b*.

Here, the first and second sustaining electrode pairs 61*a* and 61*b* and the second dielectric layer 63 may be formed on each of the rear substrate parts 60*a* and 60*b* before they are connected. Accordingly, the manufacturing process may be simplified, thereby reducing manufacturing cost and increasing productivity.

The rear substrate part 60*a* and the rear substrate part 60*b* may be coupled together by, for example, welding 67*a* or a coupling member that is fastened on the rear substrate parts 60*a* and 60*b* by a fastener such as, for example, tape 67*b* or a bolt.

The rear substrate parts 60*a* and 60*b* may be formed of a metallic material, which may be cheaper and easier to process.

According to another embodiment of the present invention, a third dielectric layer (not shown) can be formed between the rear substrate parts 60*a* and 60*b* and the first and second sustaining electrode pairs 61*a* and 61*b*/second dielectric layer 63. In other words, the first and second sustaining electrode pairs 61*a* and 61*b* and the second dielectric layer 63 may be formed on the third dielectric layer. The third dielectric layer may insulate the first and second sustaining electrode pairs 61*a* and 61*b* and the rear substrate parts 60*a* and 60*b* from each other when the rear substrate parts 60*a* and 60*b* are formed of a conductive material, such as a metallic material. The third dielectric layer may be formed of a dielectric material, such as, for example, PbO, $SiO_2$ or $Si_3N_4$, and it may be about 1-200 μm thick.

Figure 9:
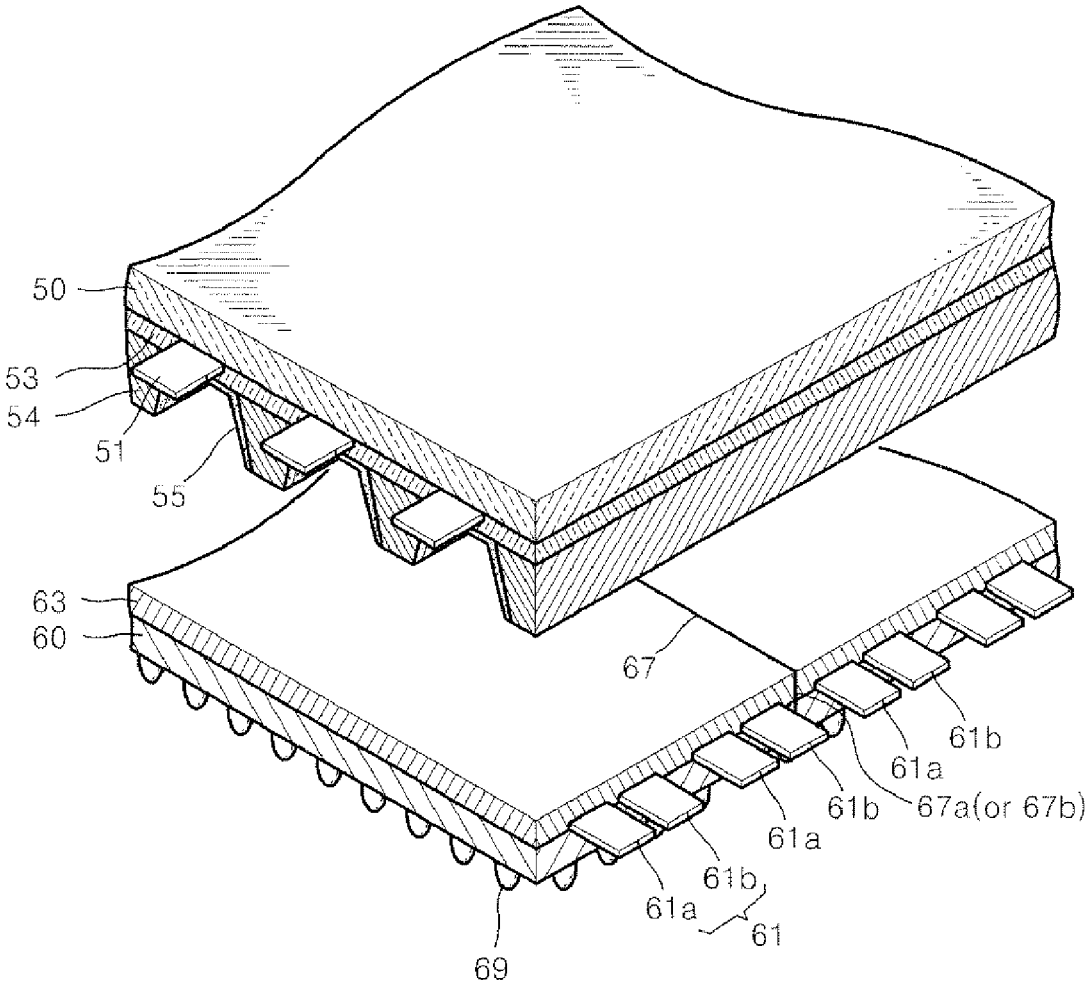
FIG. 9 is an exploded perspective view showing a transmissive PDP according to a fourth exemplary embodiment of the present invention.
Figure 10:
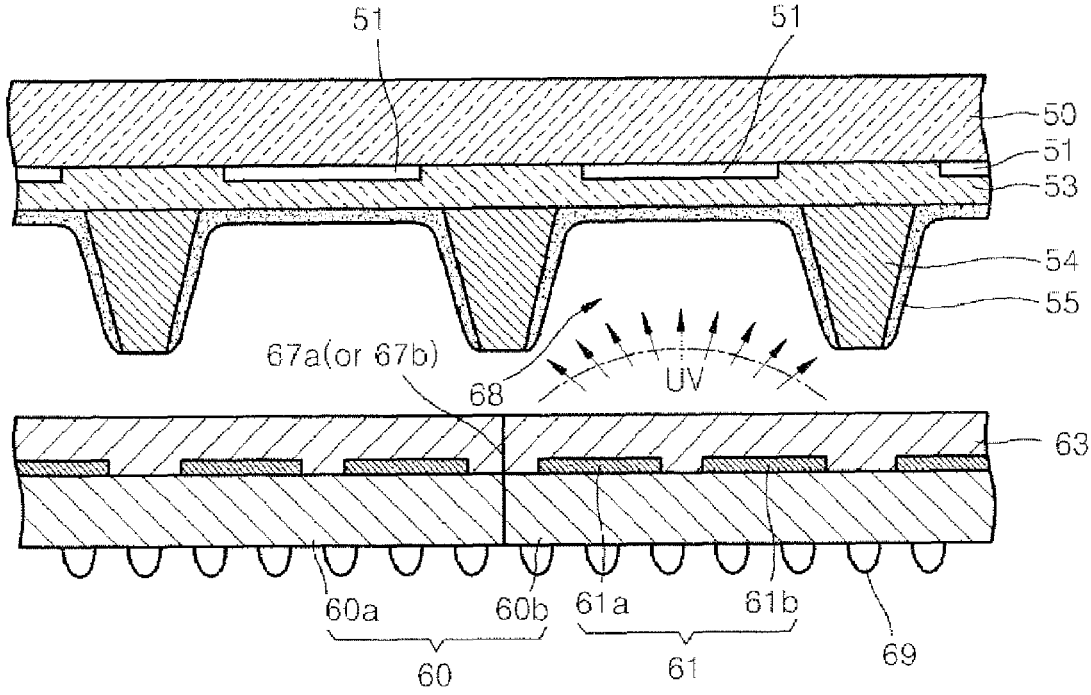
FIG. 10 is a cross-sectional view of the transmissive PDP of FIG. 9.

FIG. 9 is an exploded perspective view showing a transmissive PDP according to a fourth exemplary embodiment of the present invention, and FIG. 10 is a cross-sectional view of the transmissive PDP of FIG. 9.

In the fourth embodiment of the present invention, new elements will be described and elements that are the same as in previous embodiments are denoted by the same reference numerals as their counterparts in FIG. 7 and FIG. 8.

Referring to FIG. 9 and FIG. 10, in the fourth embodiment, a plurality of cooling pins 69, which radiate heat, may be included on an external surface of the rear substrate parts 60*a* and 60*b*. Similar to the second embodiment, the cooling pins 69 increase the external surface's contact area of the rear substrate parts 60*a* and 60*b* with air, thereby helping to dissipate heat generated during plasma discharge to the outside. Accordingly, the cooling pins 69 may slow or prevent deterioration of the PDP's operational characteristics and lifespan due to heat generated during plasma discharge.

The cooling pins 69 can be formed of a material that dissipates heat, such as, for example, a metallic material, and they may be coupled to the rear substrate parts 60*a* and 60*b* or they may be manufactured with the substrate parts as one integrated body. Further, the cooling pins 49 are not limited to the configuration shown in FIG. 9 and FIG. 10. Rather, they may have various configurations provided they dissipate heat from the PDP.

According to exemplary embodiments of the present invention, cost and effort for manufacturing a conventional large substrate can be reduced by utilizing a PDP having a rear substrate that includes at least two rear substrate parts connected to each other. Accordingly, the manufacturing process may be simplified, thereby reducing manufacturing costs and increasing productivity.

Also, heat generated during plasma discharge may be more effectively dissipated by providing cooling pins that increase a contact area between the external surface of the rear substrate parts and air.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a front substrate and a rear substrate facing each other;

a plurality of barrier ribs between the front substrate and the rear substrate;

a discharge generation unit that causes a plasma discharge in a discharge space; and a fluorescent layer that generates visible light due to discharge, wherein the rear substrate includes at least two rear substrate parts connected to each other, the at least two rear substrate parts comprising a metallic material and facing different portions of the front substrate, wherein a connection line is arranged between the at least two rear substrate parts, and wherein the front substrate and the rear substrate are separated from each other by a space in a region corresponding to the connection line.

2. The PDP of claim 1, wherein the rear substrate parts are connected by welding.

3. The PDP of claim 1, wherein the rear substrate parts are connected by tape.

4. The PDP of claim 1, further comprising a planarizing layer formed on an inner surface of the rear substrate.

5. The PDP of claim 4, wherein the planarizing layer comprises a dielectric material.

6. The PDP of claim 5, wherein the dielectric material is a material selected from the group consisting of PbO, $SiO_2$, and $Si_3N_4$.

7. The PDP of claim 6, wherein the planarizing layer is about 1μm to about 200μm thick.

8. The PDP of claim 1, further comprising cooling pins for radiating heat on an external surface of the rear substrate.

9. The PDP of claim 8, wherein the cooling pins are coupled to the rear substrate.

10. The PDP of claim 8, wherein the cooling pins are formed as an integrated body together with the rear substrate.

11. The PDP of claim 8, wherein the cooling pins are formed of a metallic material.

12. The PDP of claim 1, wherein the discharge generation unit includes a first sustaining electrode and a second sustaining electrode formed in parallel to each other on an inner surface of the front substrate.

13. The PDP of claim 12, wherein the first sustaining electrode and the second sustaining electrode are buried by a first dielectric layer.

14. The PDP of claim 12, wherein the discharge generation unit further includes an address electrode formed on an inner surface of the rear substrate and in a direction to cross the first sustaining electrode and the second sustaining electrode.

15. The PDP of claim 14, wherein the address electrode is buried by a second dielectric layer.

16. The PDP of claim 14, wherein the connection line formed between the rear substrate parts is parallel to the address electrode.

17. The PDP of claim 16, wherein a barrier rib is formed on the connection line.

18. The PDP of claim 1, wherein the discharge generation unit includes an address electrode on an inner surface of the front substrate.

19. The PDP of claim 18, wherein the address electrode is buried by a first dielectric layer.

20. The PDP of claim 18, wherein the discharge generation unit further comprises a first sustaining electrode and a second sustaining electrode formed on an inner surface of the rear substrate in parallel to each other and in a direction to cross the address electrode.

21. The PDP of claim 20, wherein the first sustaining electrode and the second sustaining electrode pair are buried by a second dielectric layer.

22. The PDP of claim 20, wherein the connection line formed between the rear substrate parts is parallel to the first sustaining electrode and the second sustaining electrode.

* * * * *